US007393219B2

(12) United States Patent
Liao

(10) Patent No.: US 7,393,219 B2
(45) Date of Patent: Jul. 1, 2008

(54) ELECTRICAL CONNECTOR ASSEMBLY WITH PICK UP CAP

(75) Inventor: Fang-Jun Liao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/788,504

(22) Filed: Apr. 20, 2007

(65) Prior Publication Data

US 2007/0249194 A1 Oct. 25, 2007

(30) Foreign Application Priority Data

Apr. 20, 2006 (CN) ..... 2006 2 0072749

(51) Int. Cl.
*H01R 13/44* (2006.01)

(52) U.S. Cl. ..... 439/135; 439/940

(58) Field of Classification Search ..... 439/135, 439/940

See application file for complete search history.

(56) References Cited

U.S. PATENT DOCUMENTS 5,688,133 A 11/1997 Ikesugi et al.
6,439,901 B1 8/2002 Ji et al.
7,033,189 B1 4/2006 Zhang et al.
7,059,876 B2 * 6/2006 Zhang et al. ..... 439/135
7,232,317 B2 * 6/2007 Ookura ..... 439/74
7,264,488 B2 * 9/2007 Harper, Jr. ..... 439/135
2007/0184690 A1 * 8/2007 Ma ..... 439/135

* cited by examiner

*Primary Examiner*—Ross N Gushi
(74) *Attorney, Agent, or Firm*—Wei Te Chung

(57) ABSTRACT

An electrical connector assembly (1) includes an elongate insulative housing (2), a pick up cap (3) mounted onto the insulative housing and a number of terminals (4) received in the insulative housing. The insulative housing includes a mounting surface (20*a*) and a mating surface (20*b*) with a plurality of passageways extending therebetween. A pair of endwalls (22) is located on two opposite ends of the insulative housing. Each terminal has a contacting portion (41) extending beyond the mating surface of the housing, and a solder portion (42) extending substantially to the mounting surface. The pick up cap is detachably attached to the mating surface of the housing, and comprises a body portion having a flattened top surface (30) and a pair of end tabs (34) extending from both ends of the body portion and detachably interfere to the endwalls of the housing. One of the end wall and the end tab forms an aligning key (25) thereof, and one of the end wall and the end tab defines an aligning slot (36) thereof. The aligning key engages with the aligning slot when the pick up is attached.

12 Claims, 6 Drawing Sheets

ELECTRICAL CONNECTOR ASSEMBLY WITH PICK UP CAP

BACKGROUND OF THE INVENTION

1. Field of the Invention

The present invention relates to an electrical connector assembly, and more particularly to an electrical connector assembly comprising a pick up cap being positioned accurately onto the electrical connector assembly.

2. Description of the Prior Art

Using vacuum suction to support and transfer an electrical connector is well known in the electronics field. A vacuum suction device for picking up and handling the electrical connector usually comprises a suction cup in physical contact with the electrical connector to apply a suction force thereto. The physical contact between the suction cup and the electrical connector requires a substantially flat surface on the electrical connector. Since most connectors do not have a flat surface, a pick up member is releasably mounted to the connector to provide the flat surface.

An example is shown in FIGS. 5-6 of the attached drawings. FIG. 5 discloses such a conventional electrical connector assembly 1' comprising an insulative housing 2', a pick up cap 3' mounted onto the insulative housing 2' and a plurality of terminals received therein.

The insulative housing 2' has two longitudinal sides defining a locking recess 21' thereof respectively. A pair of locking arms 31' extend downwardly from each lateral side of the pick up cap 3'. The locking arms 31' engage with the locking recesses 21' together for fixing the pick up cap 3' onto the insulative housing 2'. However, this kind of the connection just only can provide a generally interference engagement and the connection will be unstable for long use so that this cannot ensure a reliable position between the pick up cap 3' and the insulative housing 2', and due to the pick up cap 3' has an absorbing area which is too small, the insulative housing 2' will fall down from the pick up cap 3' during the absorbing process. Furthermore, such design did not consider using a good manner to remove the pick up cap 3' from the insulative housing 2' and could not provide protecting function for the terminals being received in the housing 2'.

Thus, an electrical connector assembly having an improved pick-up means which can overcome the above mentioned defects of conventional electrical connector is requisite.

SUMMARY OF THE INVENTION

Accordingly, an object of the present invention is to provide a pick up cap for positioning onto an electrical connector assembly securely.

Another object of the present invention is to provide a pick up cap comprising removing blocks for removing the pick up cap from the electrical connector assembly simply.

Another object of the present invention is to provide a pick up cap defining a receiving area for protecting contacting portions of terminals being received in an insulative housing.

To fulfill the above-mentioned objects, an electrical connector assembly accordance with a preferred embodiment comprises an insulative housing, a pick up cap mounted onto the insulative housing and a plurality of terminals received in the insulative housing. The insulative housing comprises a mounting surface and a mating surface with a plurality of passageways extending therebetween. A pair of endwalls is located on two opposite ends of the insulative housing. Each terminal has a contacting portion extending beyond the mating surface of the housing, and a solder portion extending substantially to the mounting surface. The pick up cap is detachably attached to the mating surface of the housing, and comprises a body portion having a flattened top surface and a pair of end tabs extending from both ends of the body portion and detachably interfere to the endwalls of the housing. One of the end wall and the end tab forms an aligning key thereof, and one of the end wall and the end tab defines an aligning slot thereof. The aligning key engages with the aligning slot when the pick up is attached.

Other objects, advantages and novel features of the present invention will become more apparent from the following detailed description when taken in conjunction with the accompanying drawings, in which:

DESCRIPTION OF PREFERRED EMBODIMENT OF THE INVENTION

Reference will now be made to the drawings to describe the present invention in detail.

Figure 1:
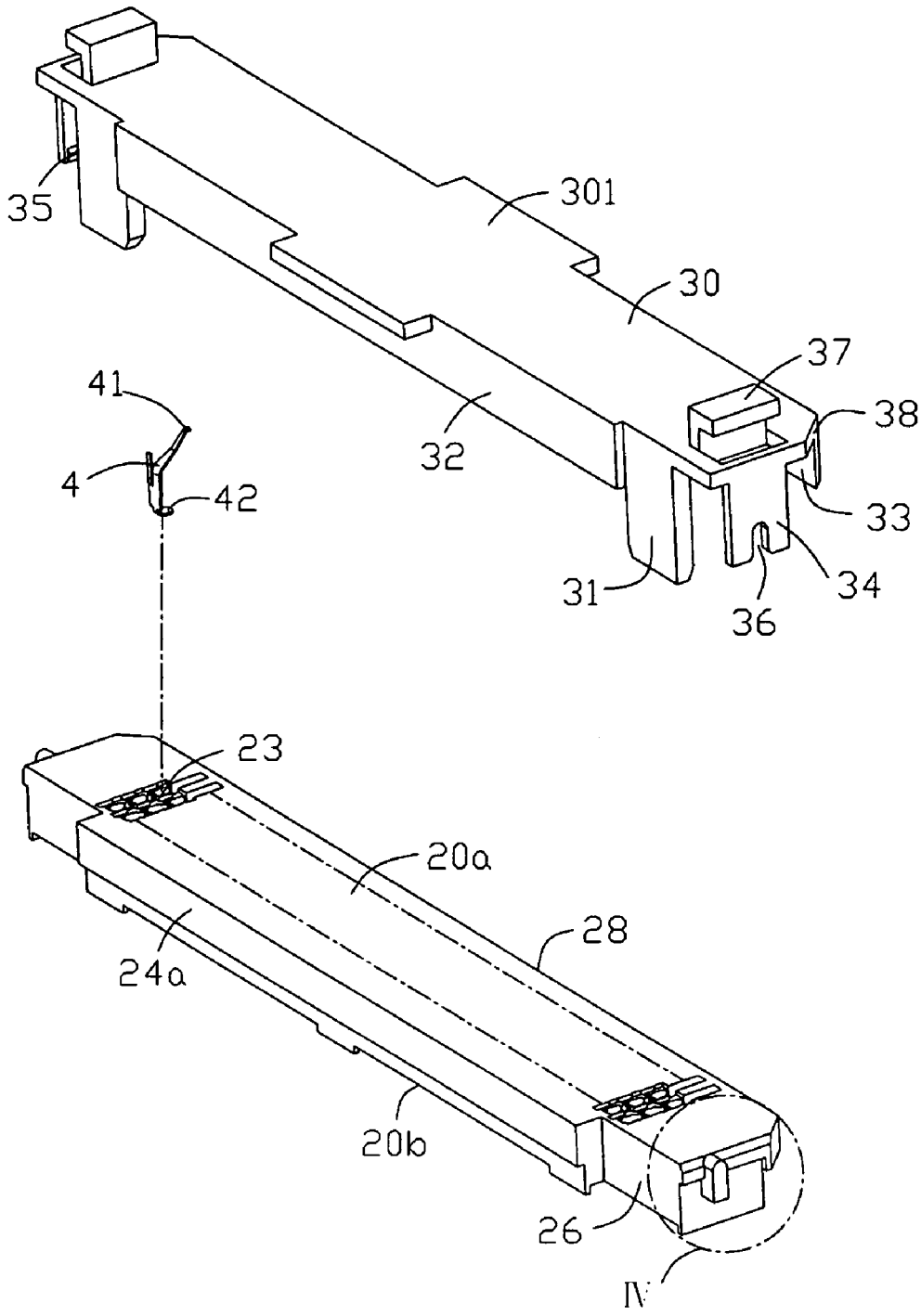
FIG. 1 is an exploded, isometric view of an electrical connector assembly of the present invention which comprising an electrical connector and a pick up cap mounted onto the electrical connector.

FIG. 1 is an exploded, isometric view of an electrical connector assembly 1 in accordance with the preferred embodiment of the present invention. The connector assembly 1 comprises an electrical connector, a plurality of terminals 4 and a pick up cap 3. The connector comprises a generally rectangular insulative housing 2 and the terminals 4 received in the insulative housing 2. The pick up cap 3 is mounted onto the insulative housing 2 for providing a plane surface to be engaged by a vacuum suction device.

Figure 2:
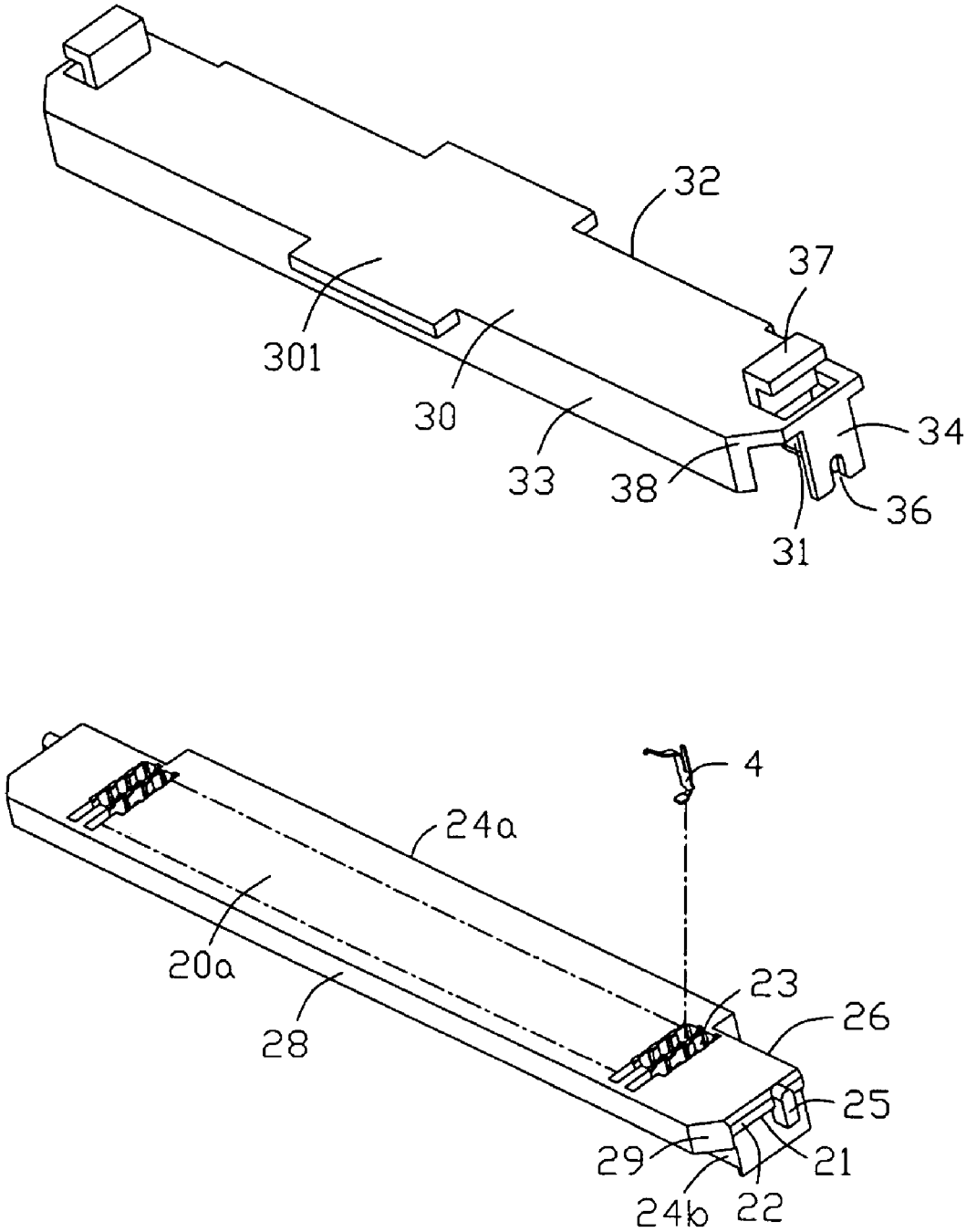
FIG. 2 is a view similar to FIG. 1, but viewed from another aspect of FIG. 1.
Figure 4:
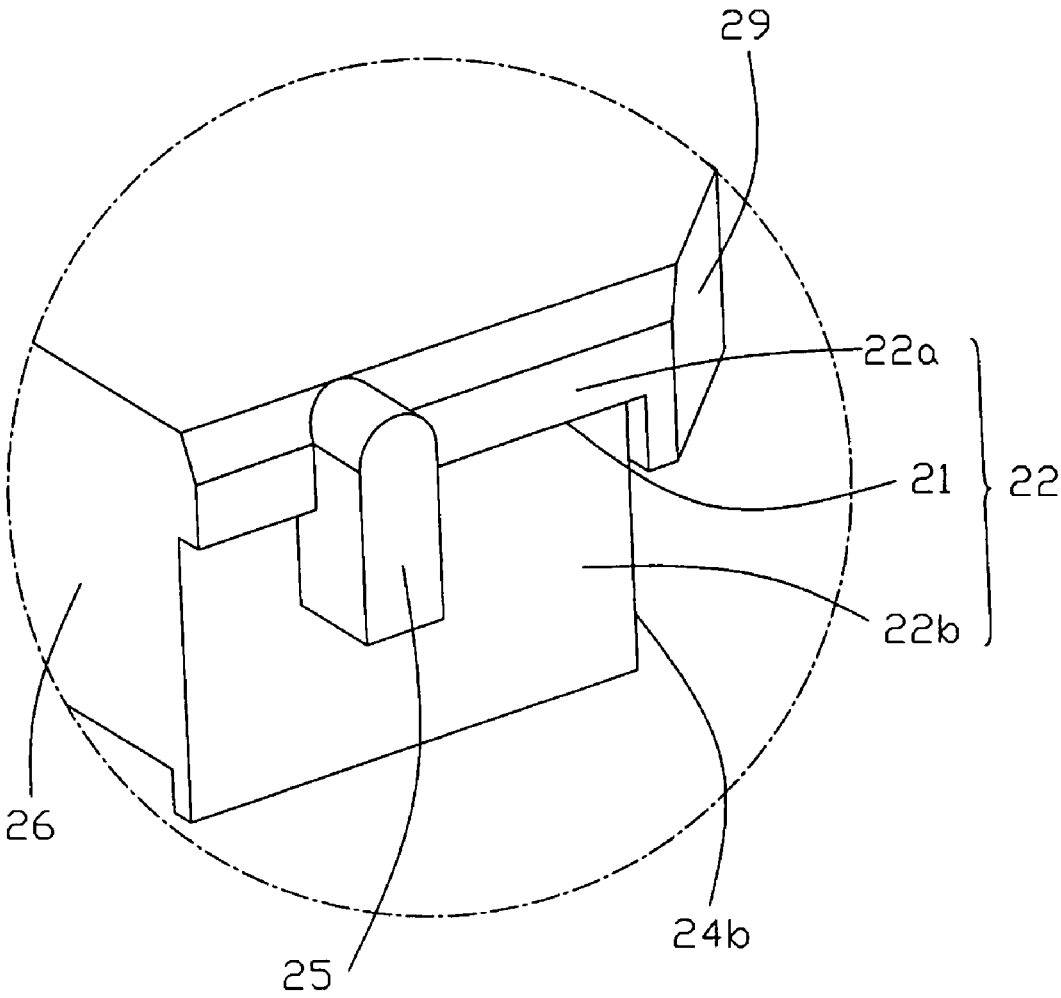
FIG. 4 is an enlarged view of A part of FIG. 1.
Figure 5:
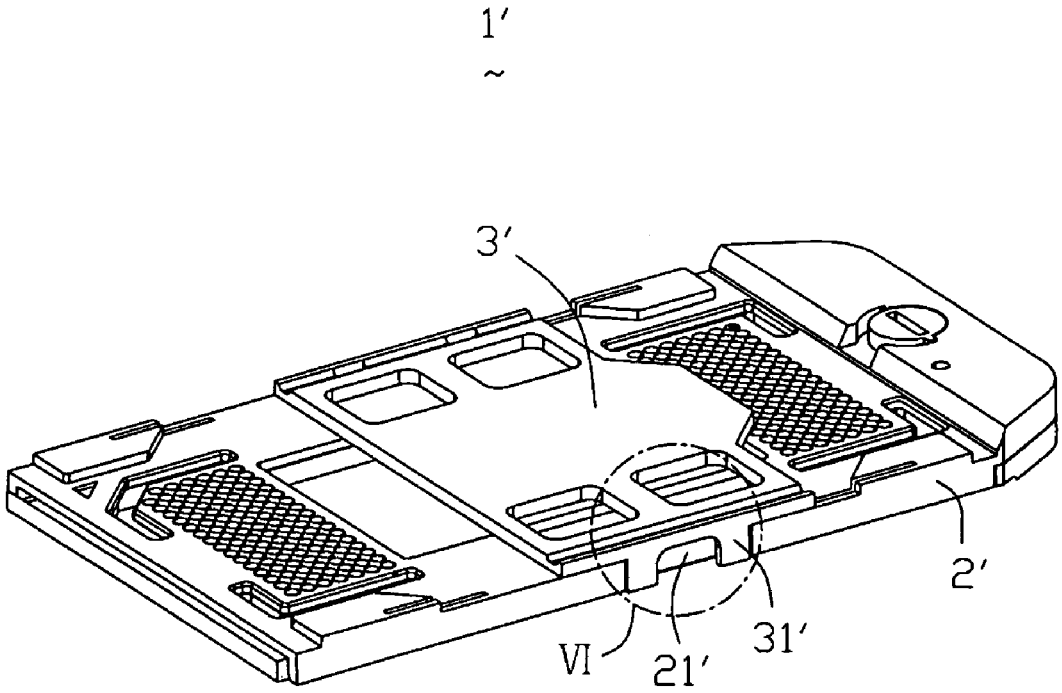
FIG. 5 (PRIOR ART)
FIG. 5 is an assembled view of a conventional electrical connector assembly which comprising an electrical connector and a pick up cap mounted onto the connector.
Figure 6:
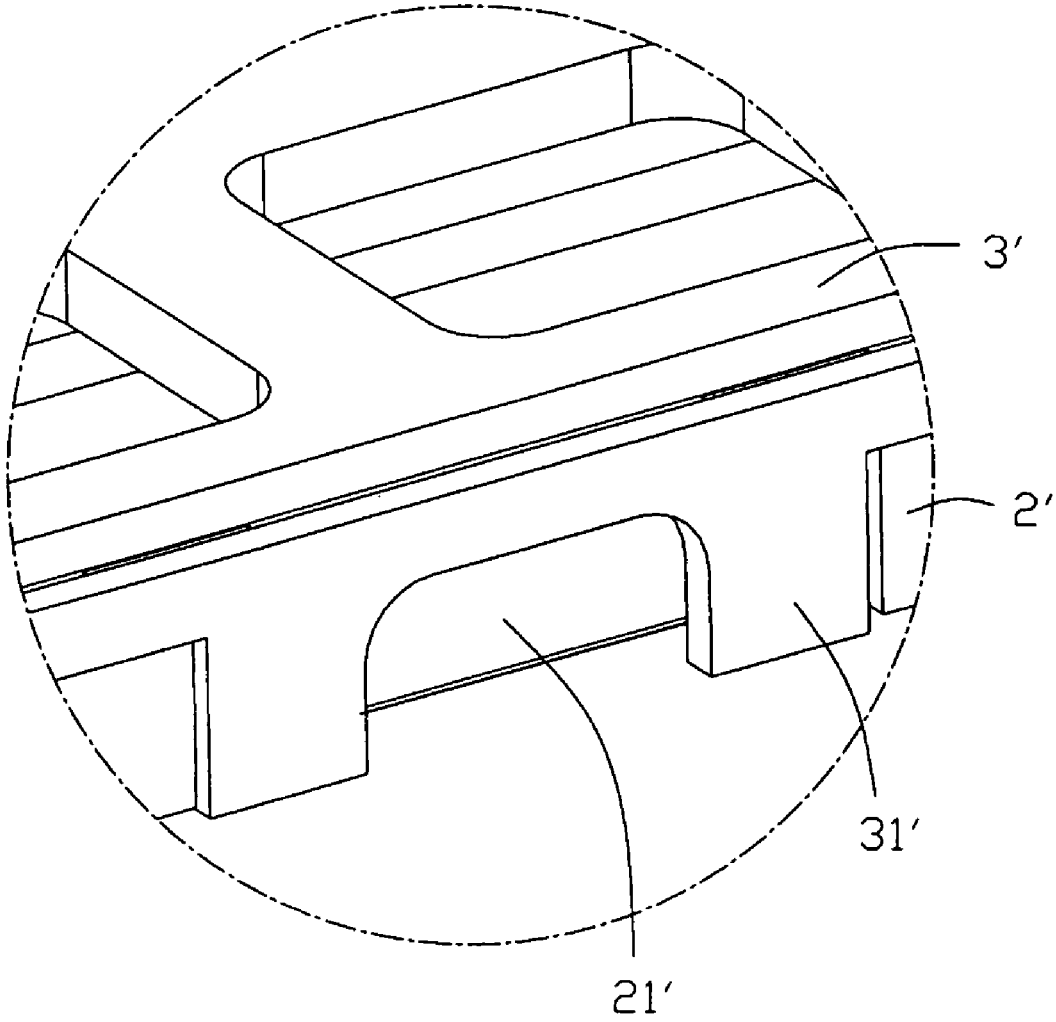
FIG. 6 (PRIOR ART)
FIG. 6 is an enlarged view of I part of FIG. 5.

Referring to FIGS. 1-2, the insulative housing 2 comprises a mating surface 20*a*, a mounting surface 20*b* and a pair of endwalls 22 extending downwardly from both ends of the mating surface 20*a*. A first sidewall 24*a* and a second sidewall 24*b* are perpendicular to the both endwalls 22, respectively. A multiplicity of terminal-passages 23 is defined in the insulative housing 2 and extends through the mating surface 20*a* and mounting surface 20*b* for receiving corresponding number of the terminals 4 therein. Each terminal 4 has a contacting potion 41 extending beyond the mating surface 20*a* and a solder portion 42 extending substantially to the mounting surface 20*b*. Referring to FIG. 4, the endwall 22 is formed with a second step portion 21 connecting to a first step portion 22*a* and a third step portion 22*b*. Each endwall 22 forms an aligning key 25 thereof. A pair of retaining recesses 26 each is defined at a corner between the first sidewall 24*a* and the endwall 22. An outer wall 28 extends upwardly and outwardly from the second sidewall 24*b* and a pair of inclined planes 29 each is formed at both ends thereon respectively.

The pick up cap 3 comprises body portion having a flattened top surface 30, a first side portion 32 and a second side portion 33 extending downwardly from the top surface 30. The top surface 30 and the first side portion 32 and the second side portion 33 together define a receiving area (not labeled) thereof. A pair of side tab 31 indents inwardly to the receiving area and extends downwardly from the top surface 30 for locking with the retaining recesses 26 of the insulative housing 2 snugly. The length of the side tab 31 is larger than the length of the first side wall 32. A pair of removing blocks 37 extends upwardly and is bent outwardly from the top surface 30 for users being convenient to use fingers to remove the pick up cap 3 from the housing 2. A pair of end tabs 34 extends downwardly from opposite ends of the top surface 30 and each end tab 34 forms a hook 35 projecting toward the cavity. An aligning slot 36 is defined at a middle portion of end of the end tab 34 for engaging with the aligning key 25 of the endwall 22 of the insulative housing 2. Thus, the pick up cap 3 could be mounted securely onto the insulative housing 2. An absorbing portion 301 extends towards both sides from the middle portion of the top surface 30 and stretches beyond the first side portion 32 and the second side portion 33, this design could increase absorbing area of the pick up cap 30, therefore, the insulative housing 2 will not fall down from the pick up cap 3 during the absorbing process. Referring to FIG. 2, a pair of cut sections 38 each is defined at a corner between the second side portion 33 and the locking arm 34.

Figure 3:
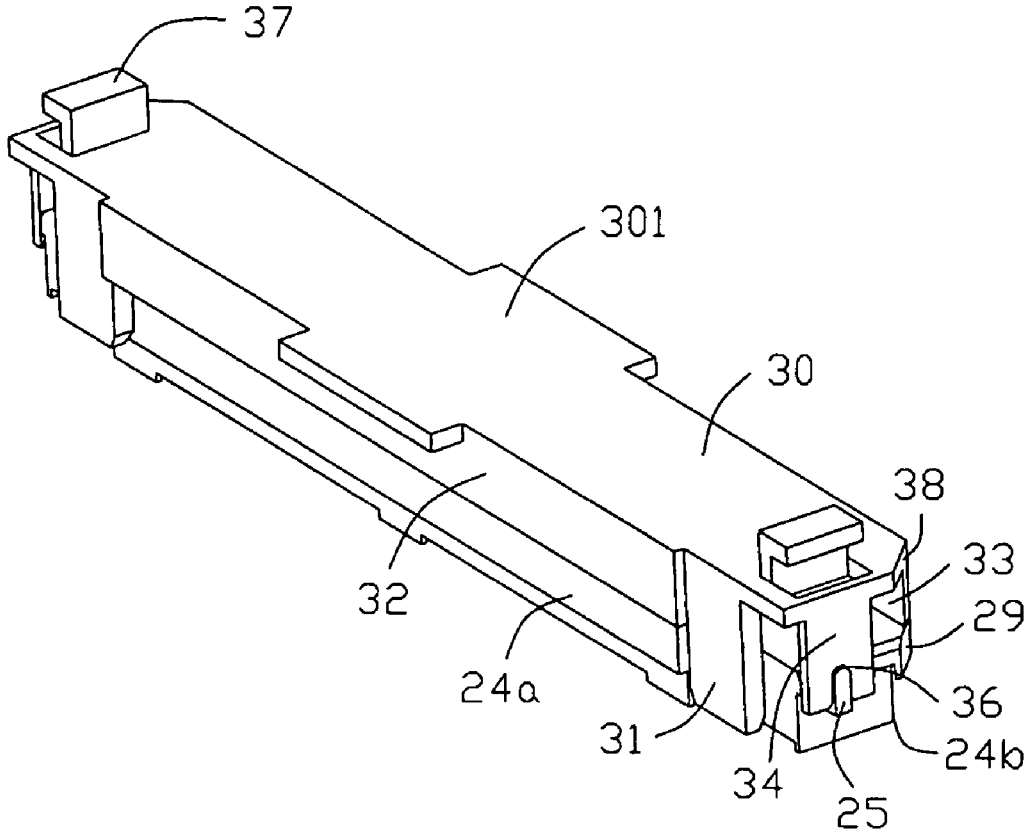
FIG. 3 is an assembled view of FIG. 1.

Referring to FIG. 3, in the assembly process, the terminals 4 are inserted into the corresponding terminal-passages 23 of the insulative housing 2, and the aligning key 25 of the insulative housing 2 mate with the corresponding aligning slot 36 of the pick up cap 3. When the pick up cap 3 is pressed down, the hook 35 is buckled with the second step portion 21 of the endwall 22, the side tabs 31 engage with the retaining recesses 26. The second side portion 33 of the pick up cap 3 abuts against the outer wall 28 of the insulative housing 2. Therefore, the pick up cap 3 could be positioned on the insulative housing 2 accurately. When the pick up 3 is detachably attached to the mating surface 20*a* of the housing 2, the receiving area is above the mating surface 20*b* and provides protecting function for the contacting portions 41 of the terminals 4. Thus, the contacting portions 41 of the terminals 4 can avoid external force impacting without causing damage to contacting portions 41. Users could use fingers to pull up the removing blocks 37 of the pick up cap 3 for removing the pick up cap 3 from the insulative housing 2 simply.

Although the present invention has been described with reference to a particular embodiment, it is not to be construed as being limited thereto. Various alterations and modifications can be made to the embodiment without in any way departing from the scope or spirit of the present invention the appended claims. For examples, the aligning slot 36 could be defined on one of the insulative housing 2 and pick up cap 3, and the corresponding aligning key 25 could be forms at one of the insulative housing 2 and pick up cap 3. The hook 35 could be formed at one of the side portions (32, 33) of the pick up cap 3 and the sidewalls (24*a*, 24*b*) of the housing 2.

What is claimed is:

1. An electrical connector, comprising:

an elongate insulative housing having a mounting surface and a mating surface with a plurality of passageways extending therebetween, a pair of endwalls located on two opposite ends;

a plurality of terminals received in the passageways of the insulative housing, and each terminal having a contacting portion extending beyond the mating surface of the housing, and a solder portion extending substantially to the mounting surface; and a pick up cap detachably attached to the mating surface of the housing, and comprising a body portion having a flattened top surface and a pair of end tabs extending from both ends of the body portion and detachably interfere to the endwalls of the housing;

wherein an inter-aligning arrangement arranged between the pick up cap and the housing so as to ensure the pick up is properly attached to the housing, and the inter-aligning arrangement includes an aligning slot located at one of the pick up cap and the housing, and an aligning key located at the other.

2. The electrical connector assembly as claimed in claim 1, wherein the top surface of the pick up cap defines a receiving area thereunder.

3. The electrical connector assembly as claimed in claim 2, wherein the pick up cap has at least one side tab extending from the body portion.

4. The electrical connector assembly as claimed in claim 3, wherein at least one of the end tab and side tab is arranged with a locking device.

5. The electrical connector assembly as claimed in claim 4, wherein the pick up cap has a hook disposed at one of the end tab and a side portion for locking to a corresponding step portion of the insulative housing.

6. The electrical connector assembly as claimed in claim 1, wherein the pick up cap forms a pair of removing blocks extending upwardly and bent outwardly from the top surface thereof.

7. The electrical connector assembly as claimed in claim 6, wherein the pick up cap has an absorbing portion extending towards both sides from the middle portion of the top surface and stretches beyond both two side portions of the pick up cap.

8. The electrical connector assembly as claimed in claim 7, wherein the length of the side tab is larger than the side portion of the pick up cap.

9. The electrical connector assembly as claimed in claim 8, wherein the insulative housing defines at least one retaining recess for engaging the side tab.

10. An electrical connector assembly comprising:

an insulative housing defining a longitudinal direction;

a plurality of contacts disposed in the housing and exposed upwardly;

a pick up cap including a planar body along said longitudinal direction;

a pair of locking arms downwardly extending at two opposite longitudinal ends of the pick up cap;

a pair of through openings formed in the planar body adjacent to said two opposite longitudinal ends;

a pair of removing block upwardly extending from the planar body adjacent to said pair of through openings, respectively;

the locking arm further including a hook overlapped with one side of the through opening in a vertical direction, and the removing block having a portion being overlapped with the other side of the through opening in said vertical direction.

11. An electrical connector assembly comprising:

an insulative housing defining two opposite end walls along a longitudinal direction;

a plurality of contacts disposed in the housing and exposed upwardly;

a pick up cap including a planar body along said longitudinal direction;

a pair of locking arms downwardly extending at two opposite longitudinal ends of the pick up cap;

a pair of through openings formed in the planar body adjacent to said two opposite longitudinal ends; and the locking arm further including a hook overlapped with one side of the through opening in a vertical direction;

for each corresponding end wall and locking arm, one of which forms a key and the other forms a key way mated with the key.

12. The electrical connector assembly as claimed in claim 11, wherein the key way is formed in the corresponding locking arm.

* * * * *